US010770014B2

(12) United States Patent
Yeh et al.

(10) Patent No.: US 10,770,014 B2
(45) Date of Patent: Sep. 8, 2020

(54) DISPLAY DEVICE

(71) Applicant: Innolux Corporation, Miao-Li County (TW)

(72) Inventors: Chia-Min Yeh, Miao-Li County (TW); Hung-Hsun Chen, Miao-Li County (TW); Hui-Min Huang, Miao-Li County (TW); Cheng-Tso Chen, Miao-Li County (TW); Li-Wei Sung, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 0 days.

(21) Appl. No.: 16/299,245

(22) Filed: Mar. 12, 2019

(65) Prior Publication Data

US 2019/0304392 A1 Oct. 3, 2019

(30) Foreign Application Priority Data

Apr. 3, 2018 (CN) ..... 2018 1 0303754

(51) Int. Cl.
*G09G 3/36* (2006.01)

(52) U.S. Cl.
CPC ... *G09G 3/3674* (2013.01); *G09G 2300/0426* (2013.01)

(58) Field of Classification Search
CPC ... G09G 2300/0408; G09G 2300/0426; G09G 2310/0267; G09G 2310/0281; G09G 3/3266; G09G 3/3674
See application file for complete search history.

(56) References Cited

U.S. PATENT DOCUMENTS 9,325,311 B1 * 4/2016 Konoshita ..... H03K 17/687
2005/0275609 A1 * 12/2005 Lee ..... G09G 3/3677 345/82
2008/0048934 A1 * 2/2008 Yamamoto ..... G02F 1/13454 345/55
2008/0088568 A1 * 4/2008 Haga ..... G09G 3/18 345/100
2009/0102824 A1 * 4/2009 Tanaka ..... G02F 1/134309 345/205
2009/0189835 A1 * 7/2009 Kim ..... G09G 3/3677 345/80

(Continued)

FOREIGN PATENT DOCUMENTS

CN 101295081 A 10/2008
CN 104732908 A 6/2015

(Continued)

*Primary Examiner* — Hong Zhou
(74) *Attorney, Agent, or Firm* — McClure, Qualey & Rodack, LLP

(57) ABSTRACT

A display device includes a display panel having a display region and a peripheral region. The display panel includes a substrate and a scan driving circuit. The scan driving circuit disposed on the substrate includes a plurality of scan driving blocks and a plurality of first conductive lines. The first conductive lines are respectively coupled to and disposed between adjacent scan driving blocks. The scan driving blocks are disposed corresponding to the peripheral region, and the first conductive lines are disposed corresponding to the display region and the peripheral region.

19 Claims, 13 Drawing Sheets

(56) References Cited

U.S. PATENT DOCUMENTS

| | | | | |
|---|---|---|---|---|
| 2014/0361961 | A1* | 12/2014 | Takahara | G09G 3/006<br>345/76 |
| 2016/0225306 | A1* | 8/2016 | Shin | G09G 3/2092 |
| 2016/0240141 | A1* | 8/2016 | Lee | G09G 3/3258 |
| 2016/0240157 | A1* | 8/2016 | Aoki | G09G 3/3666 |
| 2016/0351107 | A1* | 12/2016 | Chen | G09G 3/20 |
| 2017/0256196 | A1* | 9/2017 | Yang | G09G 3/2092 |
| 2017/0288002 | A1* | 10/2017 | Kim | G09G 3/3233 |
| 2018/0067356 | A1* | 3/2018 | Katsuta | G02F 1/133512 |
| 2018/0322837 | A1* | 11/2018 | Sakurai | G09G 3/3648 |

FOREIGN PATENT DOCUMENTS

| | | | |
|---|---|---|---|
| CN | 104867462 | A | 8/2015 |
| CN | 105139797 | A | 12/2015 |

* cited by examiner

DISPLAY DEVICE

This application claims the benefit of People's Republic of China application Serial No. 201810303754.2, filed Apr. 3, 2018, the subject matter of which is incorporated herein by reference.

BACKGROUND

Technical Field

This disclosure relates to a display device, and more particularly to a display device having a free-form display region.

Description of the Related Art

At present, with the continuous progress of the display technology, the display device has been developed to be thinner or narrow border. These display devices have been widely applied to various fields of display devices including watches, mobile phones, notebook computers, camcorders, cameras, music players, mobile navigation devices, televisions and the like. In addition to the thinning or narrow border requirement, the appearance design of the display panel has become a consideration. For example, the current display panel has been designed to have various appearances, such as free-from structures including circular, triangular or rhombus structures.

The design of the rectangular display region of the ordinary display panel is not applicable to the current trend. In response to the design of the free-from display region, the associated circuit configuration has become the projects discussed in the industry.

SUMMARY

This disclosure relates to a display device. The display device includes a display panel having a display region and a peripheral region. The display panel includes a substrate and a scan driving circuit. The scan driving circuit disposed on the substrate includes a plurality of scan driving blocks and a plurality of first conductive lines. The first conductive lines are respectively coupled to and disposed between adjacent ones of the scan driving blocks, the scan driving blocks are disposed corresponding to the peripheral region, and the first conductive lines are disposed corresponding to the display region and the peripheral region.

The above and other aspects of the disclosure will become better understood with regard to the following detailed description of the preferred but non-limiting embodiment(s). The following description is made with reference to the accompanying drawings.

DETAILED DESCRIPTION

Figure 1:
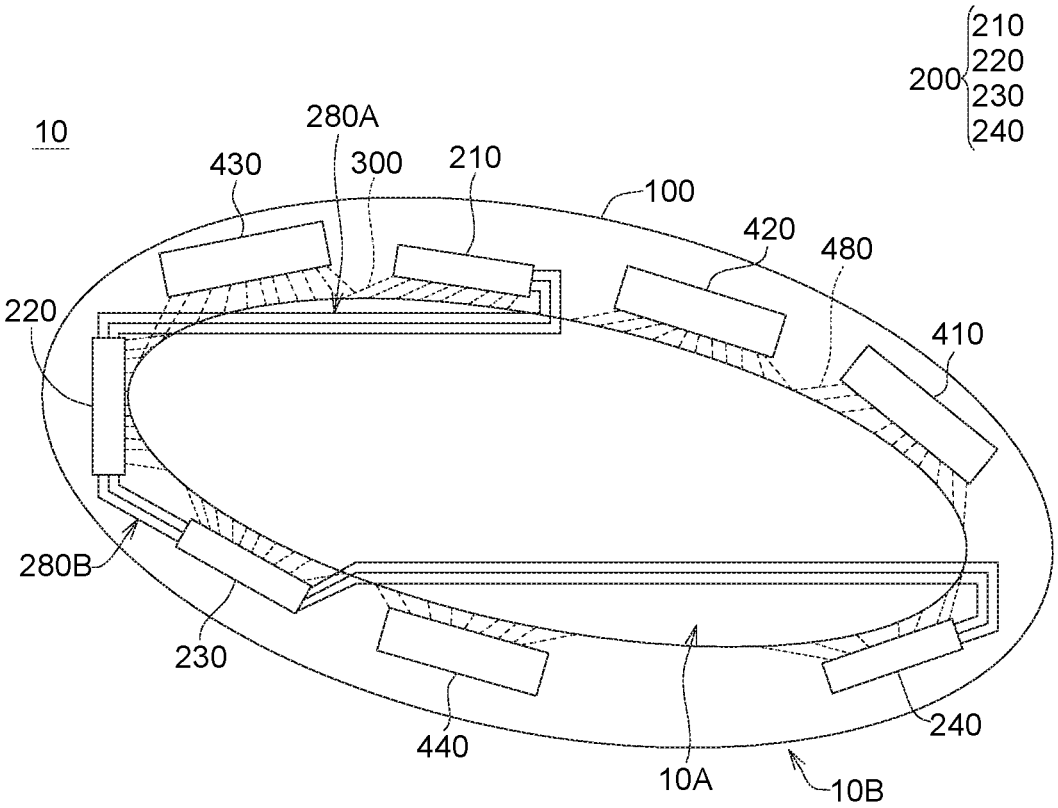
FIG. 1 is a top view showing a display device according to an embodiment of this disclosure.

Embodiments of this disclosure will be described in detail with reference to the accompanying drawings. The same reference numerals in the drawings are used to indicate the same or similar parts. It should be noted that the drawings have been simplified to clearly illustrate the contents of the embodiments, and that the detailed structure and manufacturing steps of the embodiments are merely illustrative, and are not intended to limit the scope of the disclosure. Those skilled in the art may modify or change the structures and steps according to the needs of the actual implementation.

The condition when a first material layer is disposed on or over a second material layer includes the direct contact between the first material layer and the second material layer. Alternatively, it is also possible to have one or more layers of other materials interposed, in which case there may be no direct contact between the first material layer and the second material layer.

When two adjacent first elements are described, it means that there is no other first element interposed therebetween, and there may be, for example, other elements interposed between the two adjacent first elements.

Furthermore, all or part of the technical features in one or more embodiments of this disclosure may be substituted and/or combined with all or part of the technical features of the other one or more embodiments of this disclosure to derive a further one or a plurality of embodiments of this disclosure.

FIG. 1 is a top view showing a display device according to an embodiment of this disclosure. Referring to FIG. 1, the display device includes a display panel 10 having a display region 10A and a peripheral region 10B. The display panel 10 includes a substrate 100 and a scan driving circuit 200 disposed on the substrate 100. The scan driving circuit 200 may include a plurality of scan driving blocks and a plurality of first conductive lines 280A. The first conductive lines 280A are respectively coupled to and disposed between adjacent ones of the scan driving blocks, the scan driving blocks are disposed corresponding to the peripheral region 10B, and the first conductive lines 280A are disposed corresponding to the display region 10A and the peripheral region 10B. As shown in FIG. 1, a scan driving block 210, a scan driving block 220, a scan driving block 230 and a scan driving block 240 are disposed corresponding to the peripheral region 10B, but it not restrict the number of the scan driving blocks, wherein the number of the scan driving blocks may be fewer or more. The above-mentioned adjacent scan driving blocks mean adjacent two of the scan driving blocks without another scan driving block interposed therebetween, but there may be another element (such as data driving element) present or disposed between the adjacent scan driving blocks. That is, another driving block may be disposed between the two adjacent scan driving blocks.

The display panel 10 includes a plurality of data driving blocks disposed on the substrate 100 and corresponding to the peripheral region 10B, wherein the scan driving block includes a first scan driving block and a second scan driving block, at least one of the data driving blocks is disposed between the first scan driving block and the second scan driving block, and the first conductive lines 280A are coupled to and disposed between the first scan driving block and the second scan driving block. For example, a data driving block 430 may be disposed between two of the scan driving blocks, such as the first scan driving block (e.g., the scan driving block 220) and the second scan driving block (e.g., the scan driving block 230), the first conductive lines 280A are respectively coupled between the adjacent first scan driving block (e.g., the scan driving block 220) and second scan driving block (e.g. the scan driving block 230), and the first conductive lines 280A are disposed corresponding to the display region 10A and the peripheral region 10B. In detail, the first conductive line 280A has two end portions, one of the two end portions is coupled to the scan driving block 220, and the other of the two end portions is coupled to the scan driving block 230. In addition, the scan driving circuit 200 may further include a plurality of second conductive lines 280B, the second conductive lines 280B may be respectively coupled to and disposed between two continuously disposed scan driving blocks, and the second conductive lines 280B are disposed corresponding to the peripheral region 10B. The condition of the above-mentioned two continuously disposed scan driving blocks may mean that no other driving block (such as data driving block, but it is not restricted thereto) disposed between the two continuously disposed scan driving blocks. For example, as shown in FIG. 1, the second conductive lines 280B are coupled to and disposed between two continuously disposed scan driving blocks 230 and 240, and the second conductive lines 280B are disposed corresponding to the peripheral region 10B. However, this disclosure is not restricted thereto.

In addition, the display panel 10 may include data driving blocks (e.g., a data driving block 410, a data driving block 420, a data driving block 430 and a data driving block 440), but it is not restrict the number of the data driving blocks, and the number of the data driving blocks may be fewer or more.

Figure 1A:
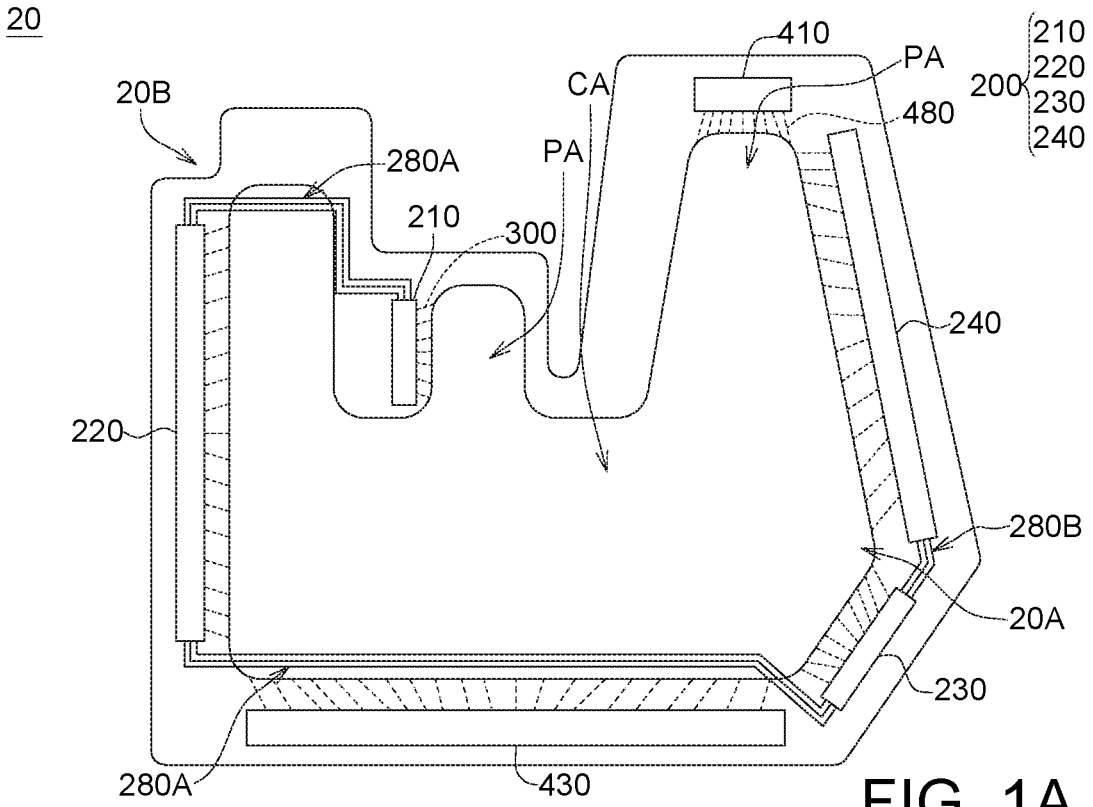
FIG. 1A is a top view showing another display device according to another embodiment of this disclosure.

In some embodiments, the display region 10A of the display panel has a special external shape (e.g., a convex region PA or a concave region CA are present between the two continuously disposed scan driving blocks, as shown in FIG. 1A), the two continuously disposed scan driving blocks may be coupled together through the first conductive lines 280A, For example, as shown in FIG. 1A, the two continuously disposed scan driving blocks 210 and 220 may be coupled together through the first conductive lines 280A corresponding to the display region 10A and the peripheral region 10B.

The first conductive lines 280A are disposed corresponding to the display region 10A and the peripheral region 10B, it is means that the first conductive lines 280A can overlap with the display region 10A and the peripheral region 10B in the normal direction of the substrate 100, or it also means that the first conductive lines 280A can span across the display region 10A and the peripheral region 10B. In some embodiments, a plurality of scan driving blocks may be coupled together through at least a first conductive line 280A and at least a second conductive line 280B to constitute the scan driving circuit 200. In some embodiments, a plurality of scan driving blocks may be coupled together through a plurality of first conductive lines 280A to constitute the scan driving circuit 200. In some embodiments, "being coupled together" may be "being electrically connected together," but it is not restricted thereto.

The scan lines 300 may be disposed on the substrate 100 and corresponding to the display region 10A and the peripheral region 10B, FIG. 1 only shows the scan lines 300 disposed corresponding to the peripheral region 10B. Each of the scan driving blocks may be coupled to a portion of the scan lines 300, and the numbers of scan lines 300 coupled to different scan driving blocks may be the same as or different from each other, and this disclosure is not restricted thereto. Through the provision of the first conductive lines 280A, the scan driving blocks can be flexibly disposed according to the requirements in the display with the rectangular, non-rectangular or free-form display region, but it is not restricted thereto.

According to the embodiment of this disclosure, the scan driving circuit 200 may include a plurality of scan driving blocks disposed separately, and different scan driving blocks may be coupled together through the first conductive lines 280A to constitute the scan driving circuit 200. In some embodiments, the scan driving blocks separated from one another may be coupled together through at least a first conductive line 280A and at least a second conductive line 280B to constitute the scan driving circuit 200, but this disclosure is not restricted thereto. According to this embodiment, through the first conductive lines 280A corresponding to the display region 10A, the scan driving blocks can be flexibly disposed on the peripheral region 10B of the display panel 10 according to the requirement, wherein these display panels 10 may have the display region 10A with the non-rectangular (free-from) outline. In addition, the relationship of timing control may be present between the scan driving blocks, but this disclosure is not restricted thereto. For example, the outline of the display region 10A may include the circular, elliptic, polygonal, arced, wavy, other irregular appearance, or a combination thereof, but this disclosure is not restricted thereto.

In some embodiments, as shown in FIG. 1, the outline of the display region 10A of the display panel 10 may be elliptic. In some embodiments, as shown in FIG. 1, the scan driving blocks 210, 220, 230 and 240 may be disposed corresponding to the peripheral region 10B along the outline of the display region 10A, and the scan driving blocks 210, 220, 230 and 240 may be not designed on one side or two opposite sides of the peripheral region 10B.

As shown in FIG. 1, the display panel 10 may include a data driving circuit. The data driving circuit may include a plurality of data driving blocks, such as the data driving blocks 410, 420, 430 and 440, but this disclosure does not restrict the number of the data driving blocks, the number of the data driving blocks may be fewer or more. The data driving blocks may be disposed on the substrate 100 and be corresponding to the peripheral region 10B. In some embodiments, the scan driving blocks and the data driving blocks may be interlaced, but this disclosure is not restricted thereto. In some embodiments, the scan driving blocks and the data driving blocks may be interlaced or arranged in a one-to-one, many-to-one, one-to-many or many-to-many manner, and the scan driving blocks and the data driving blocks may be designed according to the resolution requirement or wire configuration of the display panel.

Figure 2:
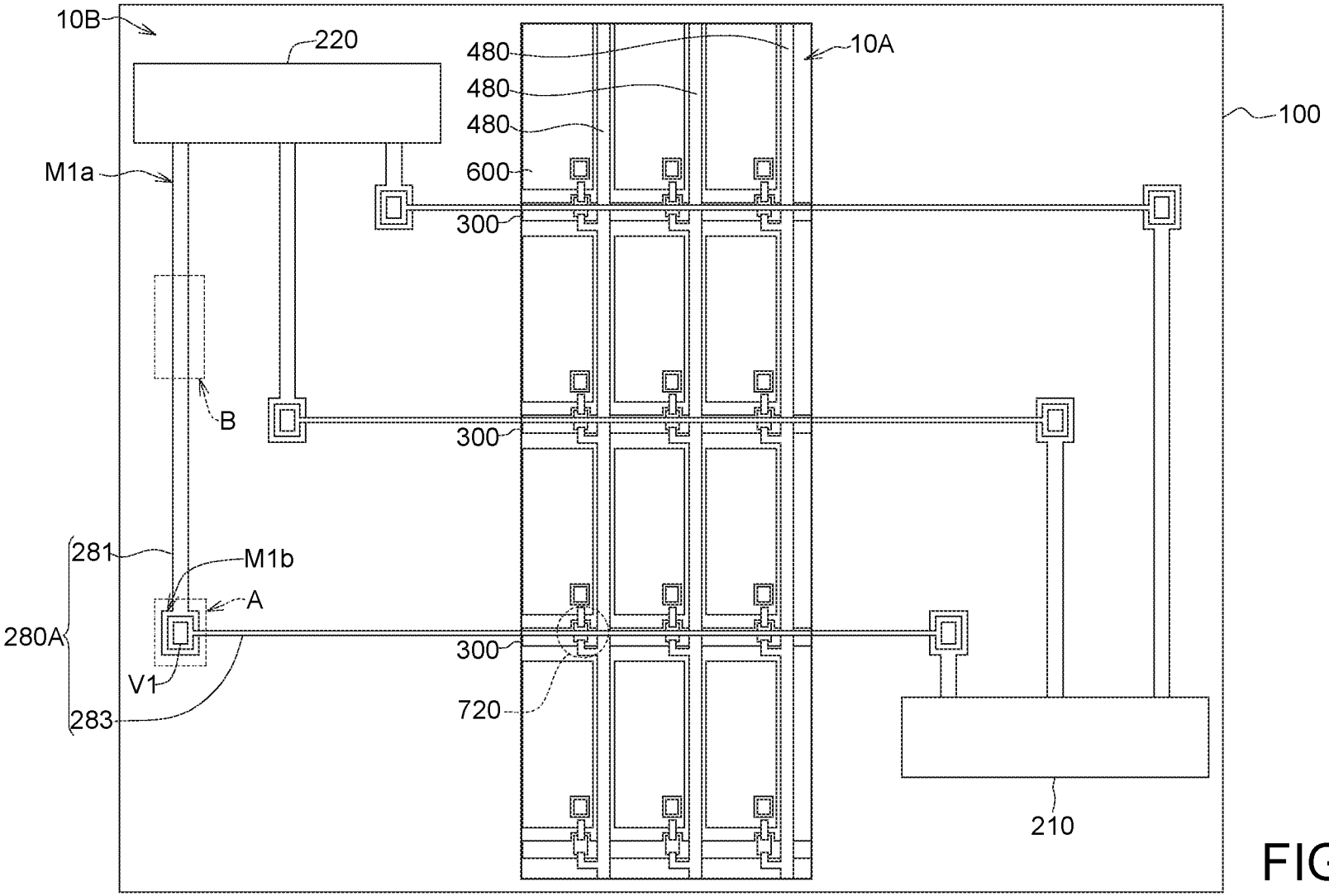
FIG. 2 is a partial top view showing a display device according to an embodiment of this disclosure.

Referring to FIGS. 1 and 2, the display panel 10 may include a plurality of data lines 480, the data lines 480 are disposed on the substrate 100 and corresponding to the display region 10A and the peripheral region 10B, and FIG. 1 only shows the data lines 480 corresponding to the peripheral region 10B. One of the data driving blocks may be coupled to a portion of the data lines 480, and the number of the data lines 480 coupled to different data driving blocks may be the same as or different from each other, and this disclosure is not restricted thereto.

FIG. 1A is a top view showing another display device according to another embodiment of this disclosure. The same or similar components as those of the foregoing embodiments are denoted by the same or similar symbols, and related descriptions of the same or similar components are referred to the foregoing embodiments, and will not be described herein again.

Referring to FIG. 1A, a display panel 20 in this embodiment has a display region 20A and a peripheral region 20B. The scan driving blocks (e.g., the scan driving blocks 210, 220, 230 and 240 without further limitation) are disposed corresponding to the peripheral region 20B. The first conductive line 280A may be disposed corresponding to the display region 20A and the peripheral region 20B, and the second conductive line 280B may be disposed corresponding to the peripheral region 20B. In some embodiments, different scan driving blocks may be coupled to the scan lines 300 with different numbers. For example, the numbers of the scan lines 300 respectively coupled to the scan driving blocks 210, 220, 230 and 240 are different from another.

In some embodiments, as shown in FIG. 1A, the outline of the display region 20A of the display panel 20 may have an irregular shape, and the display region 20A may have a plurality of convex regions PA and/or a plurality of concave regions CA. The provision of the first conductive lines 280A can make the scan driving blocks be flexibly disposed on the peripheral region 20B according to the requirement. Because the ordinary display panel 20 has the display region 20A with the non-rectangular outline, and the configuration may be made according to the configurations of the scan lines and the data lines, the scan driving blocks may be disposed in divided regions. The data driving blocks may be disposed between two of the scan driving blocks. However, the wires between two of the scan driving blocks need to be connected in series, the design of the first conductive lines 280A coupled between the two of the scan driving blocks may be disposed to decrease the space occupation of the peripheral region or to achieve narrower border. In some embodiments, the first conductive lines 280A or the second conductive lines 280B may include the wires transfer a clock signal (CLK), a reference signal (Vss), a scan start signal (STVE) and the like, but this disclosure is not limited thereto.

Figure 1B:
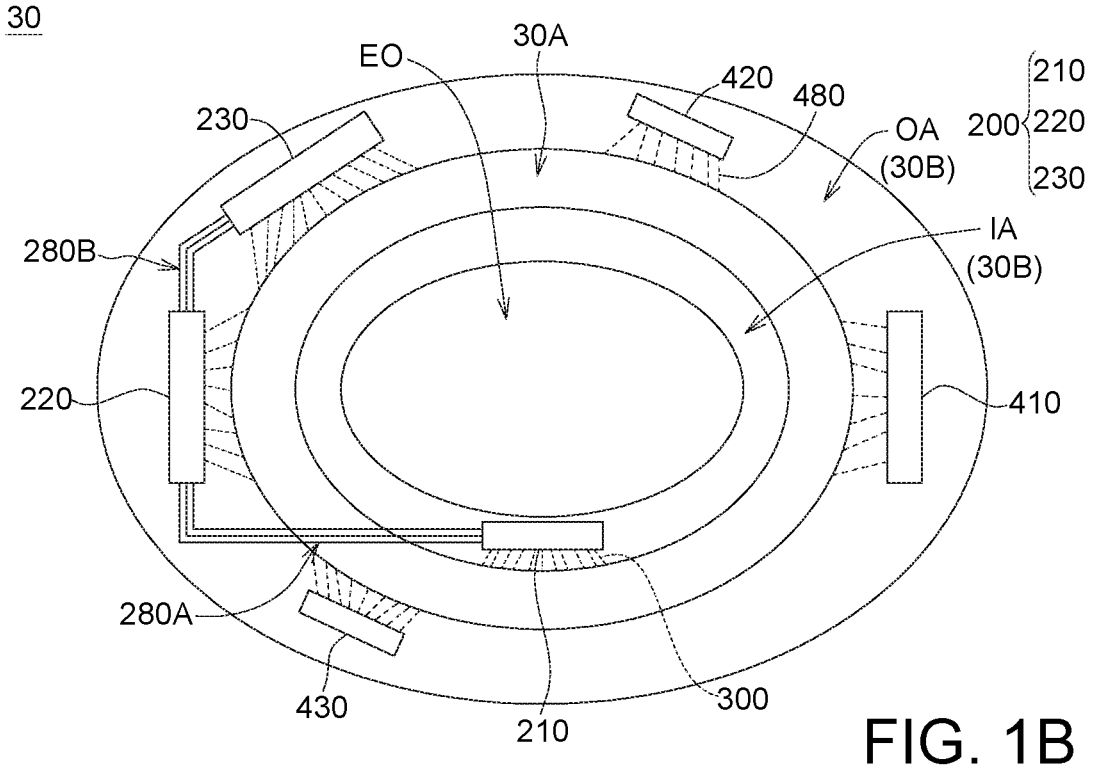
FIG. 1B is a top view showing another display device according to another embodiment of this disclosure.

FIG. 1B is a top view showing another display device according to another embodiment of this disclosure. The same or similar components as those of the foregoing embodiments are denoted by the same or similar symbols, and related descriptions of the same or similar components are referred to the foregoing embodiments, and will not be described herein again.

Referring to FIG. 1B, a display panel 30 of this embodiment may have a display region 30A and a peripheral region 30B. In some embodiments, the peripheral region 30B includes an outer edge region OA (30B) and an inner edge region IA (30B), wherein the display region 30A may be disposed between the outer edge region OA (30B) and the inner edge region IA (30B). In some embodiments, the display panel 30 may have a hollow region EO, and the outline of the display region 30A may be a ring shape. The shape of the hollow region EO may include circular, rectangular, wavy or arced or other irregular shapes, and this disclosure is not restricted thereto. In some embodiments, the display panel 30 may have a plurality of hollow regions EO. As shown in FIG. 1B, the scan driving blocks (e.g., the scan driving blocks 210, 220 and 230) are disposed corresponding to the peripheral region 30B, and the first conductive lines 280A are disposed corresponding to the display region 30A and the peripheral region 30B. Similarly, the first conductive lines 280A coupled between two of the scan driving blocks, the scan driving blocks may be disposed on the disconnected peripheral regions according to different requirements.

Figure 3A:
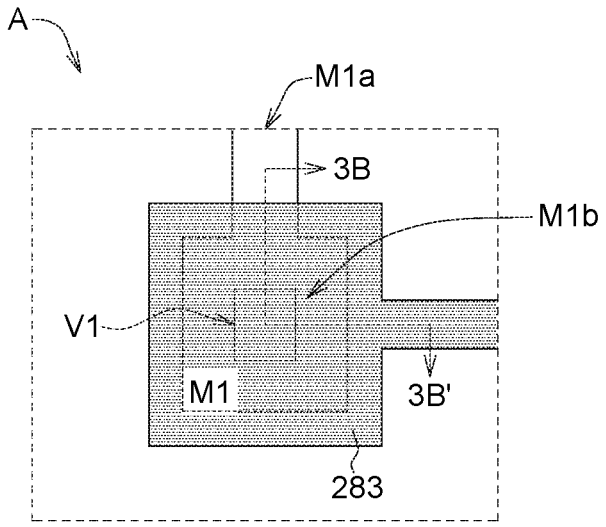
FIG. 3A is a top view showing a region A of a display device according to an embodiment of this disclosure.
Figure 3B:
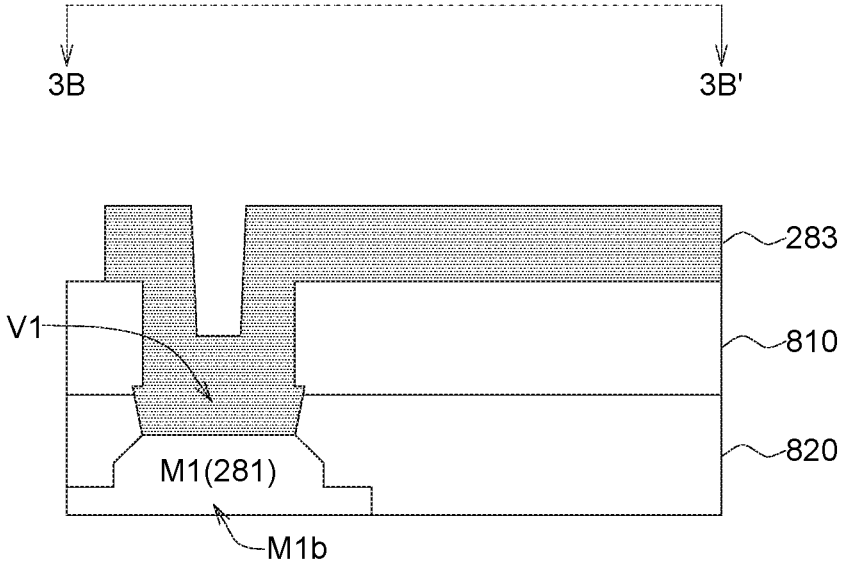
FIG. 3B is a cross-sectional view taken along a cross-sectional line 3B-3B' of FIG. 3A.

FIG. 2 is a partial top view showing a display device according to an embodiment of this disclosure. FIG. 3A is a top view showing a region A of a display device according to an embodiment of this disclosure. FIG. 3B is a cross-sectional view taken along a cross-sectional line 3B-3B' of FIG. 3A.

Referring to FIG. 2, the display panel includes a plurality of scan lines 300 disposed on the substrate 100, the scan driving blocks (e.g., the scan driving blocks 210 and 220) are respectively coupled to a portion of the scan lines 300, the data lines 480 are disposed on the substrate 100, and the data lines 480 and the scan lines 300 are interlaced. For example, an extending direction of the data line 480 may be different from an extending direction of the scan line 300. The extending direction of the data line 480 and the extending direction of the scan line 300 may form an included angle, and the included angle may be in a range from 45 degrees to 90 degrees (45 degrees ≤ included angle ≤90 degrees). In some embodiments, the included angle may be in a range from 70 to 90 degrees (70 degrees ≤ included angle ≤90 degrees), but this disclosure is not restricted thereto. A plurality of switch transistors 720 is disposed on the substrate 100, and the switch transistor 720 is coupled to one of the scan lines 300 and one of the data lines 480, wherein one of the first conductive lines 280A may overlap with one of the scan lines 300, but this disclosure is not restricted thereto. In some embodiments, a width of the first conductive line 280A overlapping with the scan line 300 may be less than a width of the scan line 300, so that the capacitance between the conductive line 280 and the scan line 300 can be decreased, the display errors caused by the lengthened RC delay can be decreased, or the display quality can be increased. The above-mentioned overlap represents that the first conductive line 280A and the scan line 300 may partially overlap or fully overlap with each other in the normal direction of the substrate 100, but it is not restricted thereto. In some embodiments, a layer of a portion of the first conductive lines 280A may be different layers from the scan lines 300 and the data lines 480. That is, at least a dielectric layer may be disposed between the first conductive lines 280A and the scan lines 300. Similarly, at least a dielectric layer may be disposed between the first conductive lines 280A and the data lines 480, but this disclosure is not restricted thereto.

In addition, the above-mentioned switch transistor may include amorphous silicon thin film transistor, polysilicon thin film transistor (e.g., low-temperature polysilicon thin film transistor, LTPS), or indium gallium zinc oxide (IGZO) thin film transistor, but this disclosure is not restricted thereto.

In some embodiments, one of the first conductive lines 280A may overlap with at least one of the switch transistors 720, wherein "overlap" is represented as that the first conductive line 280A and the switch transistor 720 may partially overlap or fully overlap with each other in the normal direction of the substrate 100, but this disclosure is not restricted thereto.

In some embodiments, as shown in FIGS. 2, 3A and 3B, each first conductive line 280A includes a first portion 281 and a second portion 283, the first portion 281 may be coupled to the second portion 283, and the first portion 281 and the second portion 283 may be different conductive layers.

As shown in FIGS. 2, 3A and 3B, the first conductive line 280A may be coupled to and disposed between two scan driving blocks (e.g., the scan driving blocks 210 and 220), and two ends of the second portion 283 of the first conductive line 280A may be respectively coupled to two first portions 281 of the first conductive lines 280A, but this disclosure is not restricted thereto. In detail, one end M1*b* of the first portion 281 of the first conductive line 280A may be coupled to the second portion 283, the other end M1*a* of the first portion 281 may be coupled to one of the scan driving blocks (e.g., the scan driving block 220 shown in FIG. 2) and correspond to the peripheral region 10B, and the second portion 283 may correspond to the display region 10A and the peripheral region 10B, but this disclosure is not restricted thereto.

In some embodiments, as shown in FIGS. 3A to 3B, the first portion 281 may be a single-layer conductive structure, and may be, such as a first conductive layer M1. One end M1*a* of the first conductive layer M1 may be coupled to a scan driving block (e.g., the scan driving block 220 shown in FIG. 2), and one end M1*b* of the first conductive layer M1 may be coupled to the second portion 283 through a via V1. Specifically, the second portion 283 may contact with the first conductive layer M1 through a via V1, but this disclosure is not restricted thereto. In some embodiments, the via V1 is disposed corresponding to the peripheral region 10B.

In some embodiments, the first portion 281 and the second portion 283 may be different conductive layers in the normal direction of the substrate 100. For example, at least one dielectric layer may be disposed between the first portion 281 and the second portion 283. In some embodiments, the first portion 281 and the second portion 283 may comprise the same conductive material. In some embodiments, the first portion 281 and the second portion 283 may comprise different conductive materials. The materials of the first portion 281 and the second portion 283 may include a metal conductive layer or a transparent conductive layer or a combination thereof. The metal conductive layer may include copper, aluminum, molybdenum, tungsten, gold, chromium, nickel, platinum, titanium, any other suitable metal, a combination thereof or any other conductive metal material with greater conductivity or the lesser impedance, but it is not restricted thereto. The transparent conductive layer may include, indium tin oxide (ITO), tin oxide (SnO), indium zinc oxide (IZO), indium gallium zinc oxide (IGZO), indium tin oxide zinc (ITZO), antimony tin oxide (ATO), oxidation antimony zinc (AZO) or any other suitable transparent conductive material, but it is not restricted thereto. When the material of the second portion 283 is the transparent conductive layer, the loss of the aperture ratio of the display device can be decreased.

FIG. 3A is a top view showing a region A of a display device according to an embodiment of this disclosure. FIG. 3B is a cross-sectional view taken along a cross-sectional line 3B-3B' of FIG. 3A. The display panel shown in FIG. 3A may further include a first dielectric layer 810 and a second dielectric layer 820. For example, the second portion 283 may be disposed on the first dielectric layer 810, and the first dielectric layer 810 and the second dielectric layer 820 may be disposed between the first conductive layer M1 and the second portion 283, but it is not restricted thereto. In some embodiments, one dielectric layer may be disposed between the first conductive layer M1 and the second portion 283. The above-mentioned dielectric layer may include an insulation material, but it is not restricted thereto.

In some embodiments, the first dielectric layer 810 and the second dielectric layer 820 may comprise the same material. In some embodiments, the first dielectric layer 810 and the second dielectric layer 820 may comprise different materials. The first dielectric layer 810 and the second dielectric layer 820 may respectively include silicon oxide, silicon nitride, silicon oxy-nitride, any other suitable dielectric material, or a combination thereof, but it is not restricted thereto.

Figure 4A:
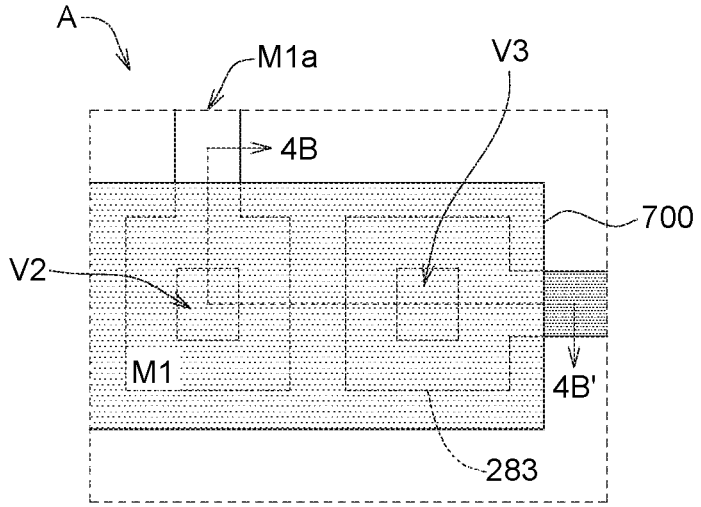
FIG. 4A is a top view showing a region A of a display device according to another embodiment of this disclosure.
Figure 4B:
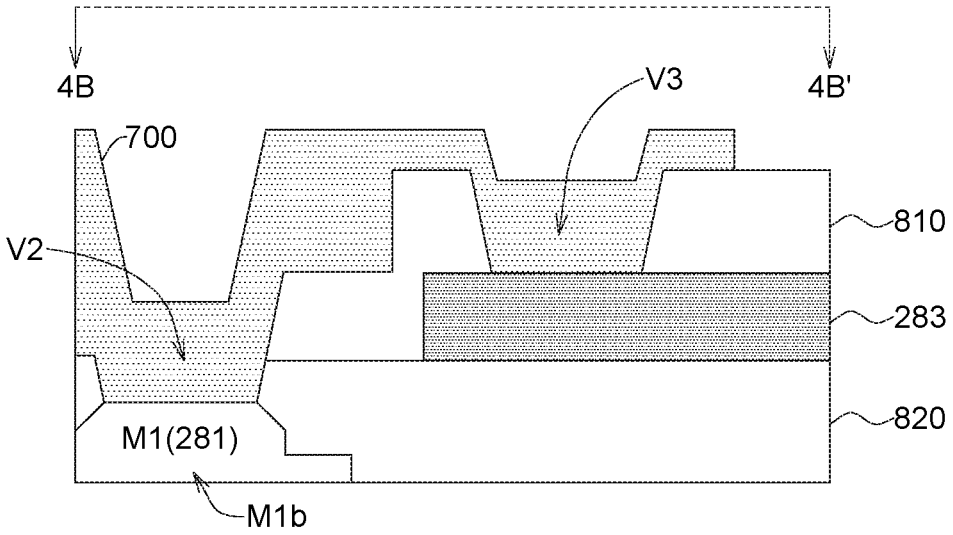
FIG. 4B is a cross-sectional view taken along a cross-sectional line 4B-4B' of FIG. 4A.

FIG. 4A is a top view showing a region A of a display device according to another embodiment of this disclosure. FIG. 4B is a cross-sectional view taken along a cross-sectional line 4B-4B' of FIG. 4A. The partial top view of the display device having the region A shown in FIG. 4A may refer to FIG. 2, and FIGS. 4A to 4B show the top-view structure and the cross-sectional structure of the region A of FIG. 2 in another embodiment. The same or similar components as those of the foregoing embodiments are denoted by the same or similar symbols, and related descriptions of the same or similar components are referred to the foregoing embodiments, and will not be described herein again.

In some embodiments, as shown in FIGS. 4A and 4B, the display panel may further include a conductive structure layer 700, wherein one end M1*b* of the first conductive layer M1 of the first portion 281 may be coupled to the second portion 283 through the conductive structure layer 700. Specifically, the second dielectric layer 820 is disposed between the first conductive layer M1 of the first portion 281 and the second portion 283, and the first dielectric layer 810 is disposed between the second portion 283 and the conductive structure layer 700. At least one dielectric layer is disposed between the first portion 281 and the second portion 283, or at least one dielectric layer is disposed between the second portion 283 and the conductive structure layer 700, or at least one dielectric layer is disposed between the first portion 281 and the conductive structure layer 700, but this disclosure is not restricted thereto. In the embodiment shown in FIGS. 4A and 4B, the first conductive layer M1 of the first portion 281, the second dielectric layer 820, the second portion 283 and the substrate of the first dielectric layer 810 may be disposed sequentially, and the first dielectric layer 810 and the dielectric layer 820 may be patterned through same mask etching process, the via V2 may be formed correspondingly above the first dielectric layer 810 and the second dielectric layer 820. In addition, a via V3 may be formed correspondingly above the second portion 283 by perforation process. The conductive structure layer 700 may be disposed in the via V2 and the via V3, and the first conductive layer M1 of the first portion 281 is coupled to the second portion 283 through the conductive structure layer 700, but it is not restricted thereto. In some embodiments, the first dielectric layer 810 and the second dielectric layer 820 may be patterned respectively by different mask etching processes, but it is not restricted thereto.

In addition, the material of the conductive structure layer 700 may include the metal conductive layer or the transparent conductive layer. The metal conductive layer may include copper, aluminum, molybdenum, tungsten, gold, chromium, nickel, platinum, titanium, any other suitable metal, a combination thereof or any other conductive material with the greater conductivity or the lesser impedance, but it is not restricted thereto. The transparent conductive layer may include indium tin oxide (ITO), tin oxide (SnO), indium zinc oxide (IZO), indium gallium zinc oxide (IGZO), indium tin oxide zinc (ITZO), antimony tin oxide (ATO), oxidation antimony zinc (AZO), any other suitable transparent conductive material, but it is not restricted thereto.

Figure 5A:
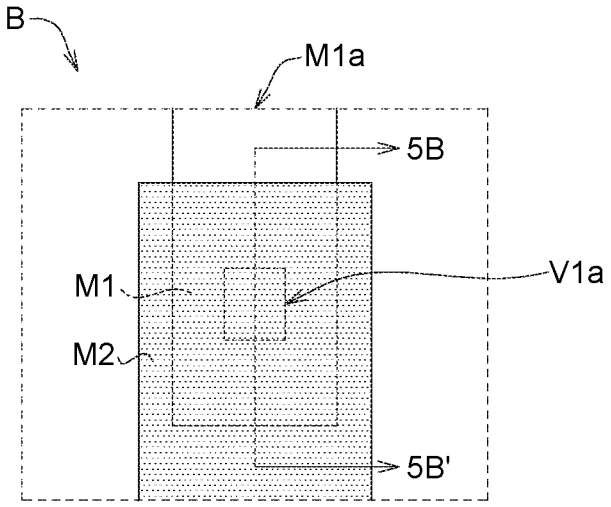
FIG. 5A is a top view showing a region B of a display device according to an embodiment of this disclosure.
Figure 5B:
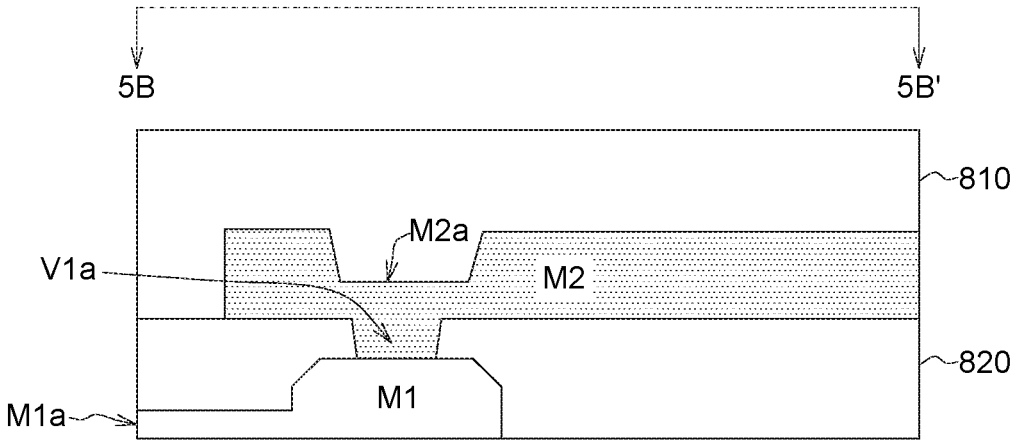
FIG. 5B is a cross-sectional view taken along a cross-sectional line 5B-5B' of FIG. 5A.

FIG. 5A is a top view showing a region B of a display device according to an embodiment of this disclosure. FIG. 5B is a cross-sectional view taken along a cross-sectional line 5B-5B' of FIG. 5A. The partial top view of the display device having the region B of FIG. 5A may refer to FIG. 2, and FIGS. 5A and 5B show the top-view structure and the cross-sectional structure of the region B of FIG. 2 in an embodiment. The same or similar components as those of the foregoing embodiments are denoted by the same or similar symbols, and related descriptions of the same or similar components are referred to the foregoing embodiments, and will not be described herein again.

In some embodiments, as shown in FIGS. 5A and 5B, the first portion 281 may be a multi-layer conductive structure, the first portion 281 may include a first conductive layer M1 and a second conductive layer M2, wherein one end of the first conductive layer M1 may be coupled to one end M2*a* of the second conductive layer M2 through a via V1*a*. Specifically, the second conductive layer M2 may be disposed in the via V1*a* to be coupled to the first conductive layer M1. The other end M1*a* of the first conductive layer M1 may be coupled to one scan driving block (e.g., the scan driving block 220 shown in FIG. 2).

In the embodiment shown in FIGS. 5A and 5B (see also FIG. 2), the first portion 281 is the multi-layer conductive structure, the first portion 281 may have a plurality of conductive layers (such as the first conductive layer M1 and the second conductive layer M2) connected together. In some embodiments, the first portion 281 is coupled to the scan driving block through the first conductive layer M1 of the first portion 281, and the second conductive layer M2 of the first portion 281 is coupled to the second portion 283. The materials of the first conductive layer M1 and the second conductive layer M2 may be different from each other. In some embodiments, the second conductive layer M2 may be the material having an impedance less than an impedance of the first conductive layer M1, but it is not restricted thereto. In some embodiments, the line width of the second conductive layer M2 may be greater than the first conductive layer M1, but it is not restricted thereto.

Figure 6A:
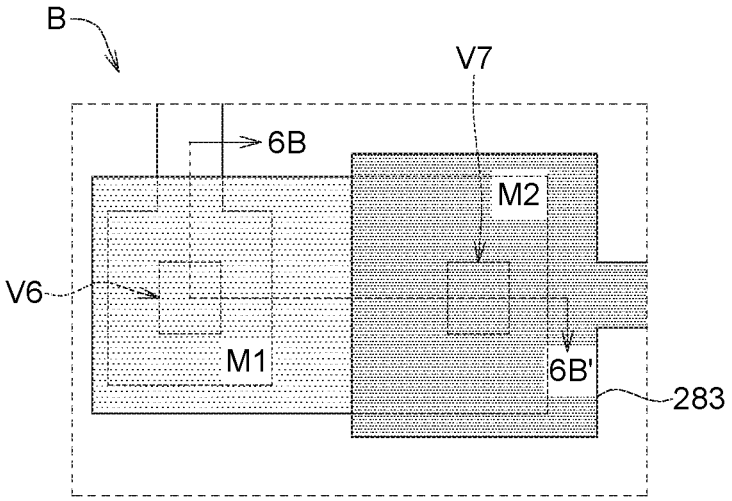
FIG. 6A is a top view showing a region A of a display device according to another embodiment of this disclosure.
Figure 6B:
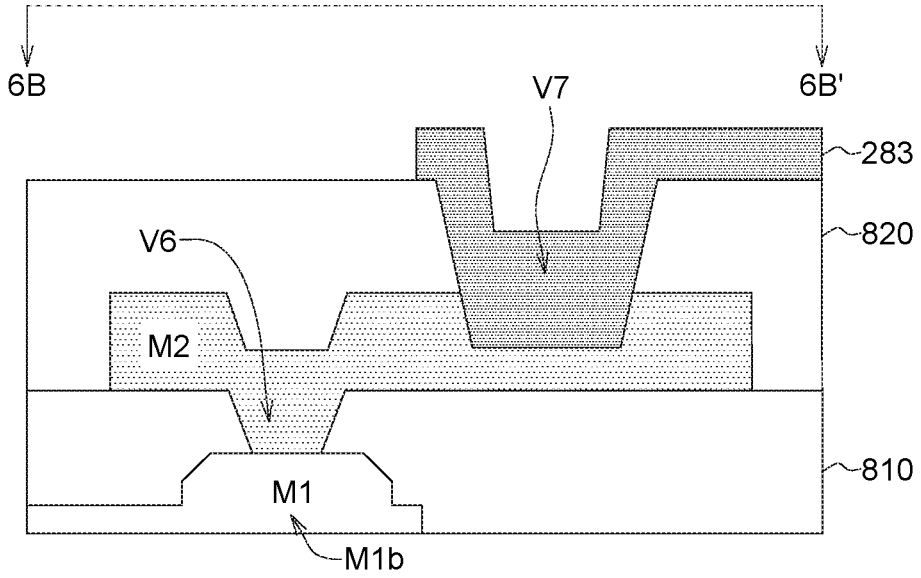
FIG. 6B is a cross-sectional view taken along a cross-sectional line 6B-6B' of FIG. 6A.

FIG. 6A is a top view showing a region A of a display device according to still another embodiment of this disclosure. FIG. 6B is a cross-sectional view taken along a cross-sectional line 6B-6B' of FIG. 6A. FIGS. 6A to 6B show the top-view structure and the cross-sectional structure of the region A of FIG. 2 in another embodiment. The same or similar components as those of the foregoing embodiments are denoted by the same or similar symbols, and related descriptions of the same or similar components are referred to the foregoing embodiments, and will not be described herein again.

In some embodiments, as shown in FIGS. 6A and 6B, one end M1*b* of the first conductive layer M1 of the first portion 281 may be coupled to the second conductive layer M2 through a via V6 (the via V6 is the through hole corresponding to a first dielectric layer 810 on one end M1*b* of the first conductive layer M1), and the second conductive layer M2 may be coupled to the second portion 283 through another via V7 (the via V7 is the through hole of a second dielectric layer 820 corresponding to the second conductive layer M2).

Figure 7A:
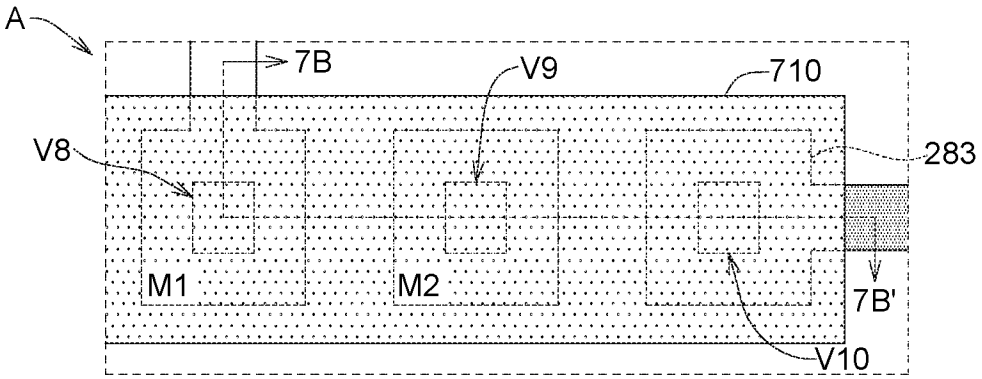
FIG. 7A is a top view showing a region A of a display device according to another embodiment of this disclosure.
Figure 7B:
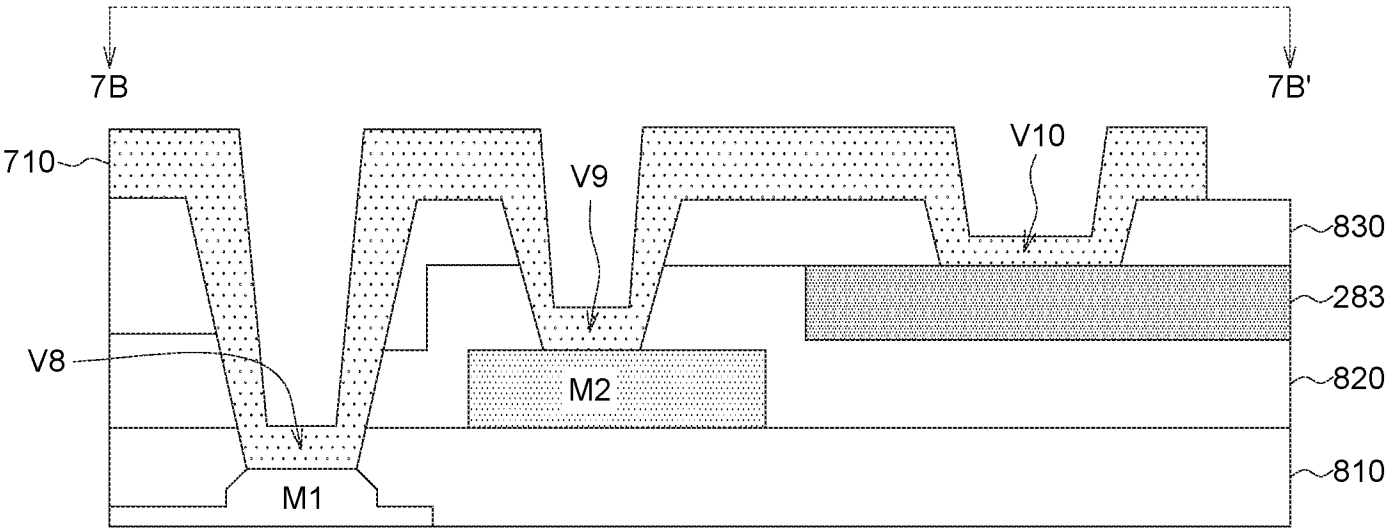
FIG. 7B is a cross-sectional view taken along a cross-sectional line 7B-7B' of FIG. 7A.

FIG. 7A is a top view showing a region A of a display device according to another embodiment of this disclosure. FIG. 7B is a cross-sectional view taken along a cross-sectional line 7B-7B' of FIG. 7A. FIGS. 7A and 7B show the top-view structure and the cross-sectional structure of the region A of FIG. 2 in yet still another embodiment. The same or similar components as those of the foregoing embodiments are denoted by the same or similar symbols, and related descriptions of the same or similar components are referred to the foregoing embodiments, and will not be described herein again.

In some embodiments, as shown in FIGS. 7A and 7B, the display panel may further include an conductive structure layer 710 and a third dielectric layer 830, and the conductive structure layer 710 may be disposed on, the third dielectric layer 830. The third dielectric layer 830 may be disposed on the first portion 281 (including the first conductive layer M1 and the second conductive layer M2) and the second portion 283. In some embodiments, at least one dielectric layer may be disposed between the first portion 281 and the second portion 283, between the second portion 283 and the conductive structure layer 700 or between the first portion 281 and the conductive structure layer 700, but it is not restricted thereto. In some embodiments, the first conductive layer M1 of the first portion 281, the second conductive layer M2 and the second portion 283 may be coupled together through the conductive structure layer 710.

Specifically, the first conductive layer M1, the second conductive layer M2 and the second portion 283 may be separated by another dielectric layer different from the first dielectric layer 810 and the second dielectric layer 820. The first conductive layer M1, the second conductive layer M2 and the second portion 283 may be coupled to or in contact with the conductive structure layer 710 respectively through vias V8, V9 and V10, and the first conductive layer M1, the second conductive layer M2 and the second portion 283 are coupled through the conductive structure layer 710, but it is not restricted thereto. For example, the conductive structure layer 710 may be disposed in the vias V8, V9 and V10 to contact with the first conductive layer M1, the second conductive layer M2 and the second portion 283 respectively, but it is not restricted thereto.

Figure 8:
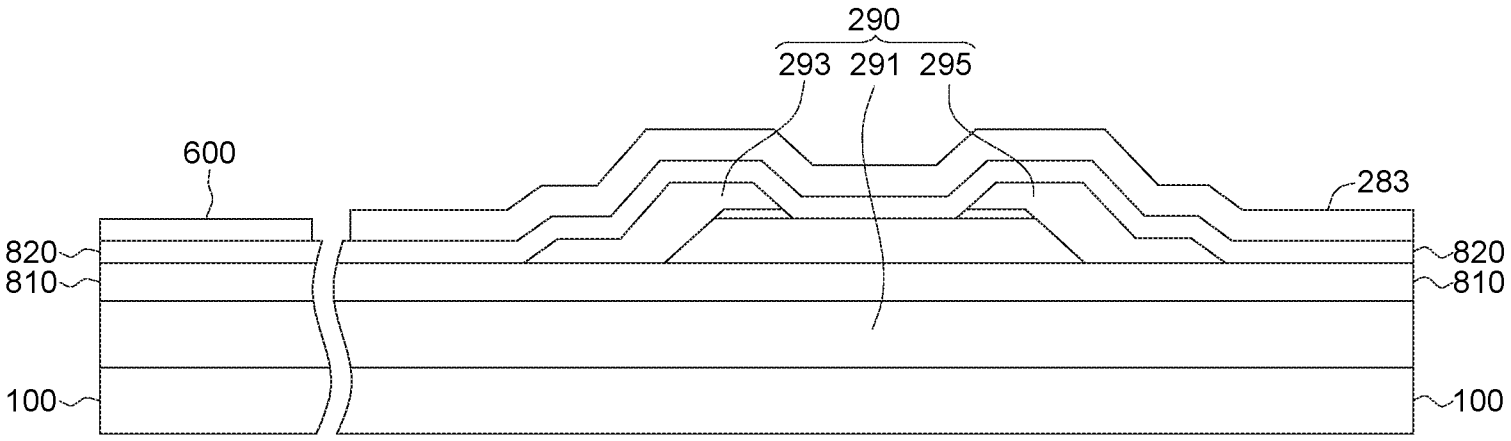
FIG. 8 is a cross-sectional view showing a transistor according to an embodiment of this disclosure.

FIG. 8 is a cross-sectional view showing a transistor according to an embodiment of this disclosure. The same or similar components as those of the foregoing embodiments are denoted by the same or similar symbols, and related descriptions of the same or similar components are referred to the foregoing embodiments, and will not be described herein again.

Referring to FIGS. 8 and 2, the scan driving circuit in this embodiment may further include a transistor 290. The transistor 290 includes a gate electrode 291, a source electrode 293 and a drain electrode 295. According to the embodiment of this disclosure, the gate electrode 291 the source electrode 293 and the drain electrode 295 may be different layers from the second portion 283.

For example, the gate electrode 291 may be a first conductive layer in the process, the source electrode 293 and the drain electrode 295 may be a second conductive layer in the process, and the second portion 283 may be a third conductive layer in the process, but it is not restricted thereto. In some embodiments, it is also possible to dispose the second portion 283, and then dispose the first conductive layer and the second conductive layer. In some embodiments, the second portion 283 may be disposed on the transistor 290. In other embodiments, the second portion 283 may be disposed below the transistor 290. That is, the second portion 283 may be firstly disposed on the substrate 100, and then the transistor 290 is disposed. In addition, the transistor illustrated in the drawing may be a top gate transistor, but the transistor 290 may be a bottom gate transistor in other embodiments.

Figure 9:
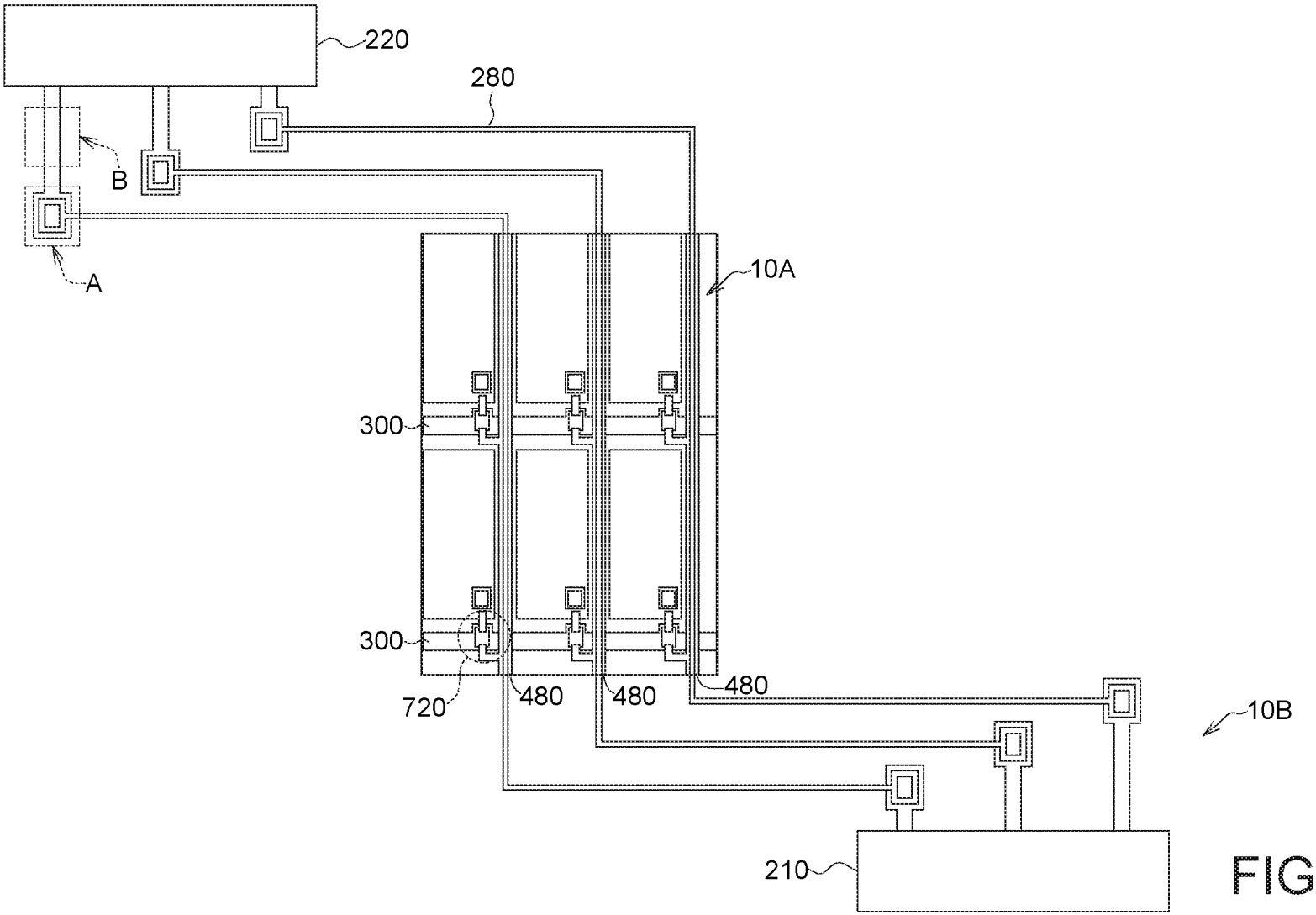
FIG. 9 is a partial top view showing a display device according to another embodiment of this disclosure.

FIG. 9 is a partial top view showing a display device according to another embodiment of this disclosure. The same or similar components as those of the foregoing embodiments are denoted by the same or similar symbols, and related descriptions of the same or similar components are referred to the foregoing embodiments, and will not be described herein again.

In some embodiments, as shown in FIG. 9, the second portion 283 disposed corresponding to the display region 10A may overlap with the data line 480 in the normal direction of the substrate 100. In some embodiments, the second portion 283 and the data line 480 may be different layers. In some embodiments, a width of the second portion 283 may be less than or equal to a width of the data line 480, the capacitance between the second portion 283 and the data line 480 can be reduced, the display errors caused by the lengthened RC delay can be reduced, the display quality can be increased, or the loss of the aperture ratio can be reduced. In some embodiments, when the width of the second portion 283 is greater than the width of the data line 480, the material of the second portion 283 may be a transparent conductive material to reduce the loss of the aperture ratio, but this disclosure is not restricted thereto.

Figure 10:
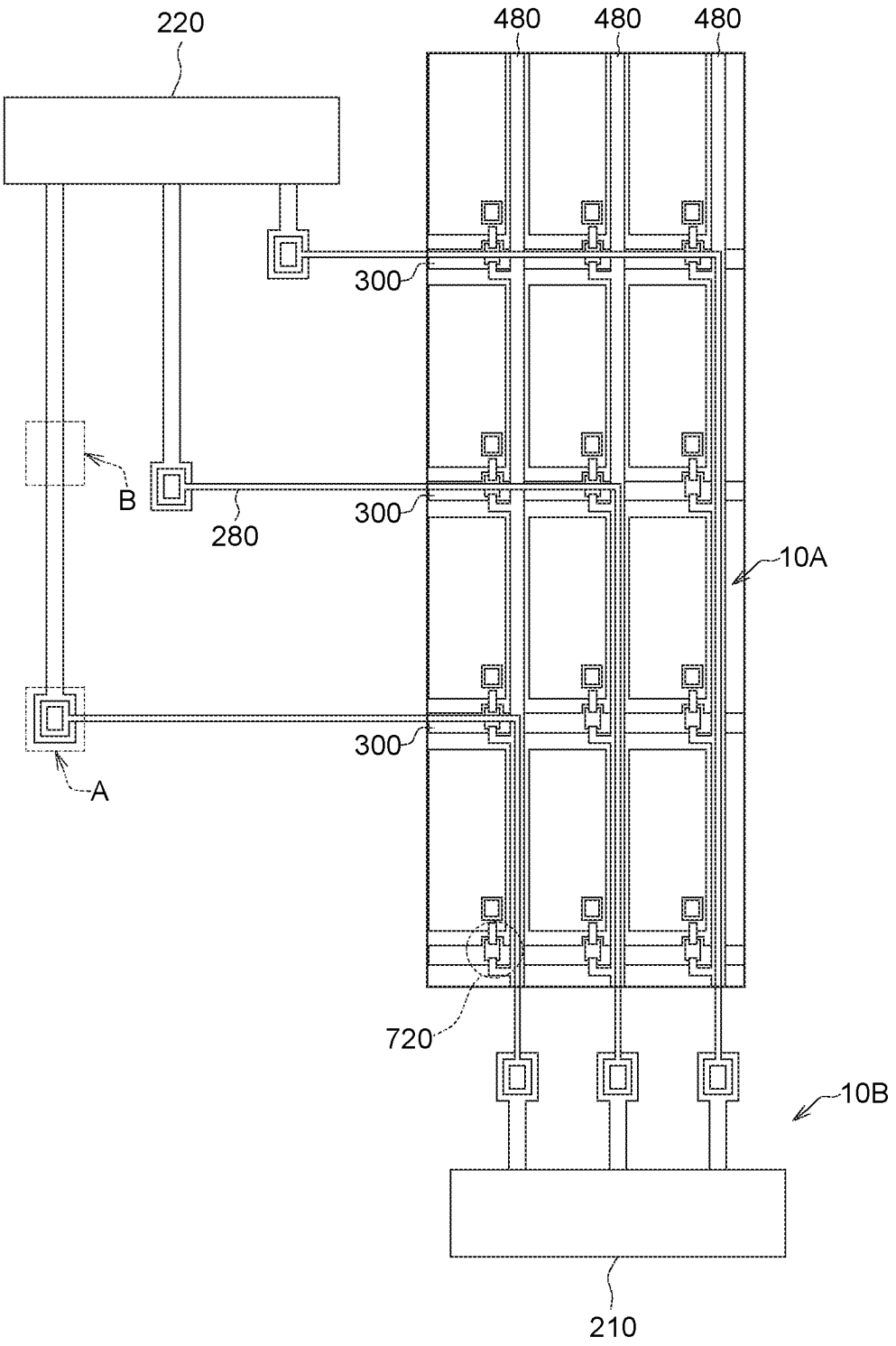
FIG. 10 is a partial top view showing a display device according to another embodiment of this disclosure.

FIG. 10 is a partial top view showing a display device according to still another embodiment of this disclosure. The same or similar components as those of the foregoing embodiments are denoted by the same or similar symbols, and related descriptions of the same or similar components are referred to the foregoing embodiments, and will not be described herein again.

In some embodiments, as shown in FIG. 10, the second portion 283 of the first conductive line 280A overlaps with the scan line 300 and the data line 480 in the normal direction of the substrate 100. At this time, the second portion 283 of the first conductive line 280A may be different conductive layers from the scan line 300 and the data line 480. The so-called "different conductive layers" represent that at least a dielectric layer is disposed between the two conductive layers, but it is not restricted thereto.

Figure 11:
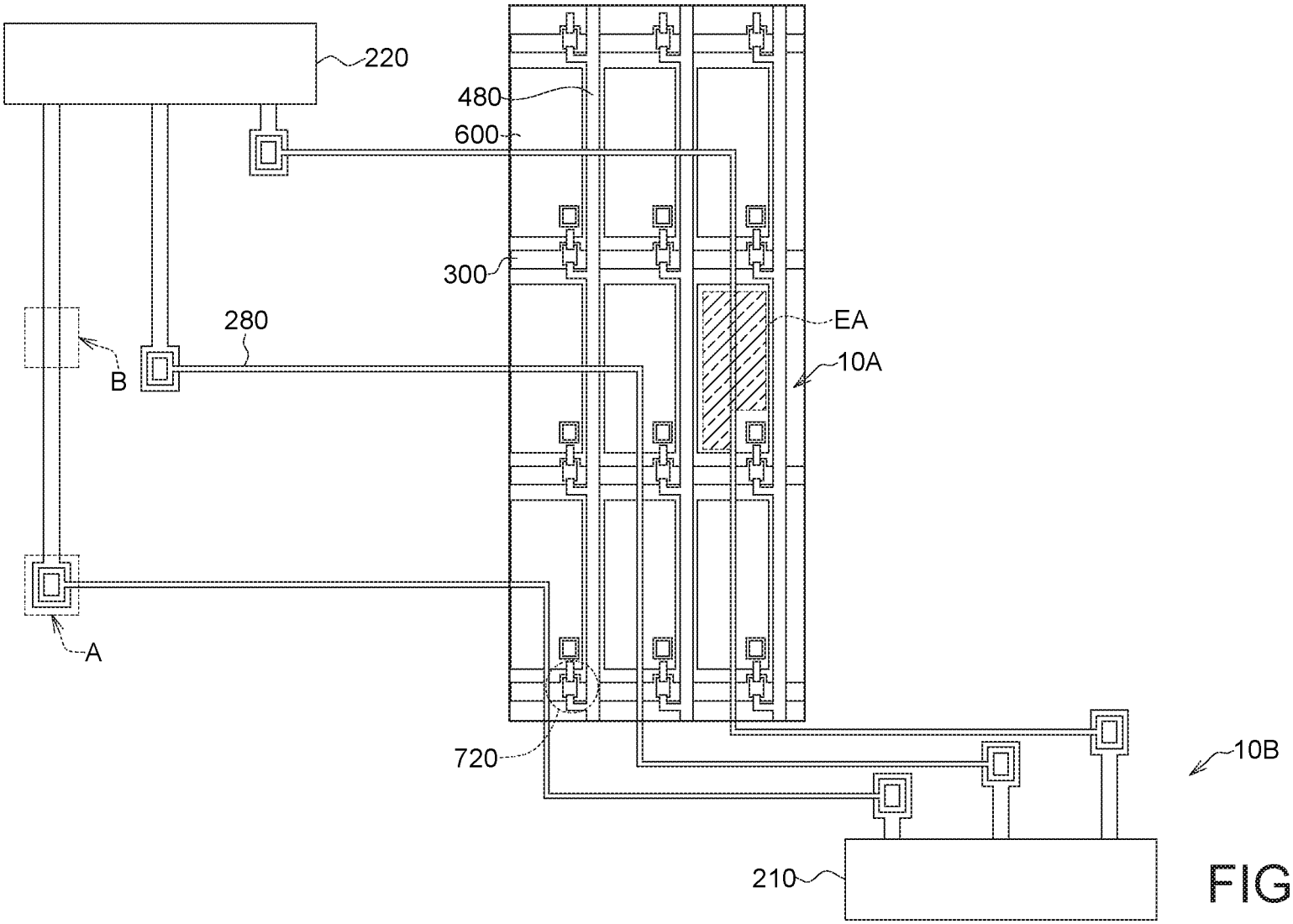
FIG. 11 is a partial top view showing a display device according to another embodiment of this disclosure.

FIG. 11 is a partial top view showing a display device according to still another embodiment of this disclosure. The same or similar components as those of the foregoing embodiments are denoted by the same or similar symbols, and related descriptions of the same or similar components are referred to the foregoing embodiments, and will not be described herein again.

Referring to FIG. 11, the display region 10A of the display panel includes a plurality of light-emitting regions EA, wherein one of the first conductive lines 280A may overlap with at least one of the light-emitting regions EA. For example, when the display device is a liquid crystal display device, the display panel thereof may further include a pixel electrode 600, wherein one pixel electrode 600 is coupled to one switch transistor 720, and an area of the pixel electrode 600 may be greater than or equal to the light-emitting region EA, but this disclosure is not restricted thereto. The projection region of the pixel electrode 600 on the substrate 100 may overlap with the projection region of the light-emitting region EA on the substrate 100, but this disclosure is not restricted thereto. For example, because a light blocking material (not shown) may be disposed corresponding to the scan line 300, the data line 480 or the switch transistor 720, and the light blocking material may be disposed on another substrate corresponding to the substrate 100, but this disclosure is not restricted thereto. The light blocking material may be a light-absorbing material, light-reflecting material or a combination thereof, but this disclosure is not restricted thereto. The light-absorbing material may include the black photoresist, black printing ink, black resin or any other suitable light blocking material, but it is not restricted thereto. Because the switch transistor 720 partially overlaps with the pixel electrode 600 in the normal direction of the substrate 100, and the light blocking material may overlap with the switch transistor 720 in the normal direction of the substrate 100, the light blocking material partially overlaps the pixel electrode 600 in the normal direction of the substrate 100. The pixel electrode 600 does not overlap with the light blocking material to form the above-mentioned light-emitting region EA, but this disclosure is not restricted thereto.

When the display device is the liquid crystal display device, the pixel electrode 600 and the second portion 283 may be the same or different conductive layers. According to the embodiment of this disclosure, the pixel electrode 600 and the second portion 283 may be different conductive layers in the process. The pixel electrode 600 includes indium tin oxide (ITO), tin oxide (SnO), indium zinc oxide (IZO), indium gallium zinc oxide (IGZO), indium tin oxide zinc (ITZO), antimony tin oxide (ATO), oxidation antimony zinc (AZO), any other suitable transparent conductive material or a combination thereof, but this disclosure is not restricted thereto.

In some embodiments, as shown in FIG. 2, when the second portion 283 does not overlap with the pixel electrode 600 in the normal direction of the substrate 100, the pixel electrode 600 and the second portion 283 may be the same conductive layer, but this disclosure is not restricted thereto.

Figure 12:
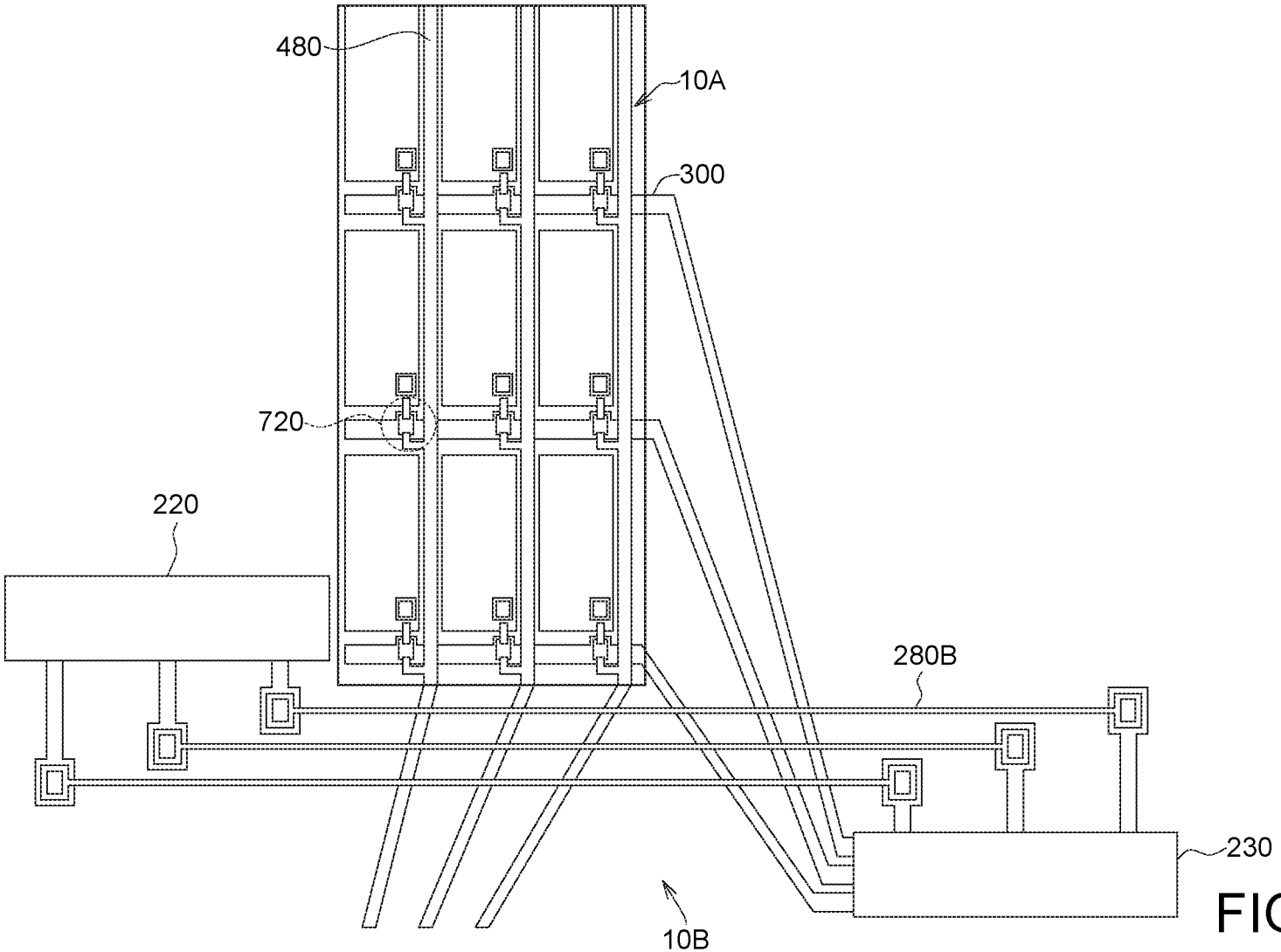
FIG. 12 is a partial top view showing a display device according to another embodiment of this disclosure.

In some other embodiments, refer to the embodiment of FIG. 12 described, wherein the second portion 283 may cross over the pixel electrode 600, so that the second portion 283 partially overlaps with the pixel electrode 600 of a display unit PA in the normal direction of the substrate 100. At this time, the pixel electrode 600 and the second portion 283 may be different conductive layers. In some embodiments, at least a portion of the first conductive lines comprises a transparent conductive material, when the second portion 283 partially overlaps with the pixel electrode 600 in the normal direction of the substrate 100, the second portion 283 comprised the transparent conductive material can decrease the loss of the aperture ratio.

In addition, the display device of this disclosure may include liquid crystal (LC), organic light-emitting diode (OLED), quantum dot (QD), fluorescent material, phosphor material, light-emitting diode (LED), micro LED or any other display medium, but this disclosure is not restricted thereto. The light-emitting region EA may be an emitting region of the display panel operated at the highest gray scale (e.g., the gray scale of 255).

When the display device is an organic light-emitting diode, the light-emitting region EA may be the region defined by the pixel define layer (PDL). When the display device is the light-emitting diode, the light-emitting region EA may be a light emitted region of the light-emitting diode in a pixel region. This disclosure does not restrict the number of the light-emitting diodes included in a pixel region. For example, one pixel region may correspond to one light-emitting diode or a plurality of light-emitting diodes, the light-emitting diodes can emit the lights with the same color or different colors, but this disclosure is not restricted thereto. In some embodiments, when the display device is the light-emitting diode, the light-emitting diode may be disposed on an opening defined by the light-shielding material. At this time, the light-emitting region EA may be defined as the opening region of the light-shielding material. In some embodiments, at least a first conductive line 280A may overlap with at least a light-emitting region EA. In this case, when the first conductive line 280A includes the transparent conductive material, and the loss of the aperture ratio can be decreased.

FIG. 12 is a partial top view showing a display device according to another embodiment of this disclosure. The same or similar components as those of the foregoing embodiments are denoted by the same or similar symbols, and related descriptions of the same or similar components are referred to the foregoing embodiments, and will not be described herein again.

Referring to FIGS. 1 and 12, the second conductive line 280B between two continuously disposed scan driving blocks (e.g., the scan driving blocks 220 and 230) may correspond to the peripheral region 10B, but this disclosure is not restricted thereto. In another example, no other driving circuit block (data driving block) may be disposed between the two continuously disposed scan driving blocks, but this disclosure is not restricted thereto.

While the disclosure has been described by way of example and in terms of the preferred embodiments, it is to be understood that the disclosure is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A display device, comprising:

a display panel having a display region and a peripheral region, the display panel comprising:

a substrate;

a scan driving circuit disposed on the substrate, the scan driving circuit comprising a plurality of scan driving blocks and a plurality of first conductive lines, the plurality of first conductive lines respectively coupled to and disposed between adjacent ones of the plurality of scan driving blocks, the plurality of scan driving blocks disposed corresponding to the peripheral region, and the plurality of first conductive lines disposed corresponding to the display region and the peripheral region; and a plurality of scan lines, wherein the plurality of scan lines is disposed on the substrate, the plurality of scan driving blocks is respectively coupled to a portion of the plurality of scan lines, and one of the plurality of first conductive lines overlaps with one of the plurality of scan lines.

2. The display device according to claim 1, wherein the display panel further comprises a plurality of data driving blocks disposed on the substrate and corresponding to the peripheral region, wherein the plurality of scan driving blocks comprises a first scan driving block and a second scan driving block, at least one of the plurality of data driving blocks is disposed between the first scan driving block and the second scan driving block, and the plurality of first conductive lines is coupled to and disposed between the first scan driving block and the second scan driving block.

3. The display device according to claim 1, wherein the display panel further comprises a plurality of second conductive lines, the plurality of second conductive lines is coupled to and disposed between other adjacent ones of the plurality of scan driving blocks, and the plurality of second conductive lines is disposed corresponding to the peripheral region.

4. The display device according to claim 1, wherein a width of the one of the plurality of first conductive lines is less than or equal to a width of the one of the plurality of scan lines.

5. The display device according to claim 1, wherein the display region comprises a plurality of light-emitting regions, and one of the plurality of first conductive lines overlaps with at least one of plurality of the light-emitting regions.

6. The display device according to claim 1, wherein at least a portion of the plurality of first conductive lines comprises a transparent conductive material.

7. The display device according to claim 1, wherein the display panel further comprises:

a plurality of switch transistors disposed on the substrate, wherein the plurality of switch transistors is coupled to the plurality of scan lines respectively, and one of the plurality of first conductive lines overlaps with at least one of the plurality of switch transistors.

8. The display device according to claim 1, wherein each of the plurality of first conductive lines comprises a first portion and a second portion, the first portion is coupled to the second portion, and the first portion and the second portion are different conductive layers.

9. The display device according to claim 8, wherein the first portion comprises a first conductive layer (M1), the second portion contacts with the first conductive layer through a via.

10. The display device according to claim 9, wherein the via is disposed corresponding to the peripheral region.

11. The display device according to claim 8, wherein the first portion comprises a first conductive layer (M1), the first conductive layer is coupled to the second portion through a conductive structure layer.

12. The display device according to claim 8, wherein the first portion comprises a first conductive layer (M1), the second portion comprises a second conductive layer (M2), an impedance of the second conductive layer is less than an impedance of the first conductive layer.

13. The display device according to claim 8, wherein the scan driving circuit further comprises a transistor disposed on the substrate, and the second portion is disposed on the transistor.

14. The display device according to claim 8, wherein the display panel further comprises a pixel electrode, and the pixel electrode and the second portion are different conductive layers.

15. The display device according to claim 1, wherein the display panel further comprises:

a plurality of data lines disposed on the substrate, wherein the plurality of data lines and the plurality of scan lines are interlaced, a portion of the first conductive lines are different layers from the plurality of scan line or the plurality of data lines.

16. The display device according to claim 1, wherein an outline of the display region includes circular, elliptic, polygonal, arced, wavy, other irregular appearance, or a combination thereof.

17. The display device according to claim 1, wherein the display region includes a plurality of convex regions or a plurality of concave regions.

18. The display device according to claim 1, wherein the display panel has a hollow region, and the display region is a ring shape.

19. The display device according to claim 1, wherein the plurality of first conductive lines transfers a clock signal, a reference signal or a scan start signal.

* * * * *